US008054276B2

(12) United States Patent
Yamashita

(10) Patent No.: US 8,054,276 B2
(45) Date of Patent: Nov. 8, 2011

(54) DISPLAY APPARATUS AND DISPLAY DRIVE CIRCUIT

(75) Inventor: Hiroshi Yamashita, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 883 days.

(21) Appl. No.: 12/031,273

(22) Filed: Feb. 14, 2008

(65) Prior Publication Data

US 2008/0198126 A1 Aug. 21, 2008

(30) Foreign Application Priority Data

Feb. 15, 2007 (JP) ..... 2007-034511

(51) Int. Cl.
*G09G 3/36* (2006.01)

(52) U.S. Cl. ..... 345/98; 345/99

(58) Field of Classification Search ..... 345/99, 345/98, 100

See application file for complete search history.

(56) References Cited

U.S. PATENT DOCUMENTS

| | | | | |
|---|---|---|---|---|
| 4,841,369 | A * | 6/1989 | Nishizawa et al. | 348/302 |
| 4,974,093 | A * | 11/1990 | Murayama et al. | 348/308 |
| 5,164,970 | A * | 11/1992 | Shin et al. | 377/54 |
| 5,351,145 | A * | 9/1994 | Miyata et al. | 349/48 |
| 5,900,853 | A * | 5/1999 | Shimizu et al. | 345/98 |
| 6,049,321 | A * | 4/2000 | Sasaki | 345/99 |
| 6,160,533 | A * | 12/2000 | Tamai et al. | 345/89 |
| 6,542,139 | B1 | 4/2003 | Kanno | |
| 7,227,541 | B2 | 6/2007 | Ando | |
| 2001/0033254 | A1 * | 10/2001 | Furusato et al. | 345/55 |

FOREIGN PATENT DOCUMENTS

| | | | |
|---|---|---|---|
| EP | 0 574 142 | A1 | 12/1993 |
| EP | 0 609 843 | A1 | 8/1994 |
| EP | 1 457 958 | A2 | 9/2004 |
| JP | 10-83168 | A | 3/1998 |
| JP | 2001-109436 | A | 4/2001 |
| JP | 2004-110046 | A | 4/2004 |
| JP | 2004-279730 | A | 10/2004 |
| JP | 2006-201805 | A | 8/2006 |

OTHER PUBLICATIONS

Japanese Office Action dated Dec. 16, 2008 w/English translation (four (4) pages).

Extended European Search Report dated Jul. 20, 2009 (Seven (7) pages).

* cited by examiner

*Primary Examiner* — Amare Mengistu
*Assistant Examiner* — Aaron M Guertin
(74) *Attorney, Agent, or Firm* — Crowell & Moring LLP

(57) ABSTRACT

Disclosed is a display apparatus including: an X driver to drive signal lines; and a Y driver to drive scanning lines; wherein the X driver is provided with: a line buffer to latch the receive display data in a plurality of latch circuits; and a horizontal shift register to sequentially output latch signals to the latch circuits in accordance with an operation clock, wherein the horizontal shift register includes: a plurality of output lines; and a plurality of flip-flops to output the latch signals to each of the plurality of output lines, wherein the horizontal shift register is configured to output the latch signals from any of adjoining two output lines among the plurality of output lines by a same operation clock, and to output a latch signal from a subsequent stage output line following to the two output lines by the next operation clock.

10 Claims, 9 Drawing Sheets

DISPLAY APPARATUS AND DISPLAY DRIVE CIRCUIT

BACKGROUND OF THE INVENTION

1. Field of the Invention

The present invention relates to a display apparatus for performing a display operation by driving scanning lines and signal lines, and a display drive circuit to drive the scanning lines and the signal lines.

2. Description of Related Art

For example, the display data having the resolution of 1024×768 pixels is sometimes input into a liquid crystal panel having the screen resolution of 1440×900 pixels, and the image of the display data is expanded by a resolution conversion to perform image output to the whole screen.

This resolution conversion has been conventionally preformed as follows generally. That is, after the low resolution display data has been once expanded in a buffer memory, the display data is converted into that having a high resolution by a resealing process. After that, the display data is transmitted to the timing controller of the liquid crystal panel to perform the display output of the display data (see, Japanese Patent Application Laid-Open Publications Nos. 2006-201805 and 2004-110046).

Moreover, as the related art relative to the present invention, Japanese Patent Application Laid-Open Publication No. 2004-279730 discloses a display apparatus including a duplicate scanning mode to drive two scanning lines at a time and a normal scanning mode to drive one scanning line at a time.

A dedicated signal processing circuit that performs the resealing process of display data and a buffer memory have been conventionally necessary in order to expand and display low resolution display data onto a high resolution liquid crystal panel, and the cost has been expensive for those components.

Moreover, because a high speed transfer operation is needed to high resolution display data, if the low resolution display data is converted into the high resolution display data to be supplied to the liquid crystal panel as mentioned above, then the display data becomes necessary to be transferred at a high speed transfer rate corresponding to the high resolution thereof despite having been a low resolution image, and the conventional technique consequently has a problem of the much power consumption of a transmitting and receiving circuit of the display data by just that much.

SUMMARY OF THE INVENTION

It is an object of the present invention to provide a display apparatus and a display drive circuit, both capable of outputting low resolution display data by expanding it onto a high resolution screen without using any dedicated signal processing circuits and any buffer memories.

It is another object of the present invention to provide a display apparatus and a display drive circuit, both capable of outputting low resolution display data by transferring it at a low transfer rate for a low resolution to expand and output it onto a high resolution screen.

According to a first aspect of the invention, in order to achieve the object of the present invention, a display apparatus includes: an X driver to drive a plurality of signal lines; and a Y driver to drive a plurality of scanning lines; wherein a display operation is performed by driving the scanning lines and the signal lines, wherein the X driver is provided with: a line buffer to receive sequential input of display data to latch the receive display data in a plurality of latch circuits; and a horizontal shift register to sequentially output latch signals to the plurality of latch circuits in accordance with an operation clock, wherein the horizontal shift register includes: a plurality of output lines through which the latch signals are output; and a plurality of flip-flops to output the latch signals to the plurality of output lines, the flip-flops being provided respectively to the plurality of output lines, wherein the horizontal shift register is configured to be able to output the latch signals from any of adjoining two output lines among the plurality of output lines by a same operation clock, and to be able to output a latch signal from a subsequent stage output line following to the two output lines by the next operation clock.

According to a second aspect of the invention, in order to achieve the object of the present invention, a display apparatus includes: an X driver to drive a plurality of signal lines; and a Y driver to drive a plurality of scanning lines; wherein a display operation is performed by driving the scanning lines and the signal lines, wherein the Y driver is provided with a vertical shift register to output timing signals to sequentially drive the plurality of scanning lines, wherein the vertical shift register includes: a plurality of output lines to output the timing signals to the plurality of scanning lines; and a plurality of flip-flops to output each of the timing signals to the plurality of output lines, each of the flip-flops being provided respectively to the plurality of output lines, wherein the vertical shift register is configured to be able to output the timing signals from any of adjoining two output lines among the plurality of output lines by a same operation clock, and to be able to output a timing signal from a subsequent stage output line following to the two output lines by a next operation clock.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENTS

In the following, an embodiment of the present invention will be described on the basis of the attached drawings.

Figure 1:
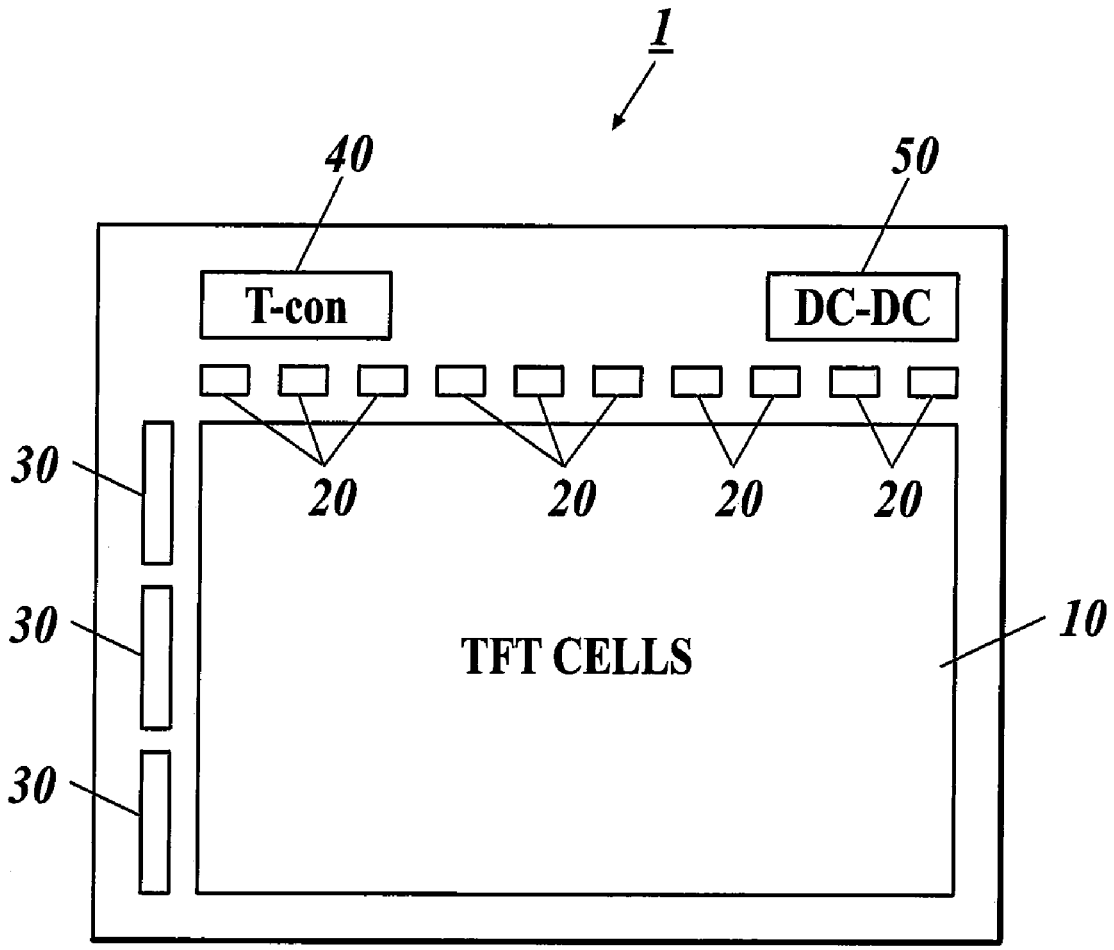
FIG. 1 is a configurational view showing the whole configuration of a display apparatus of an embodiment of the present invention.

FIG. 1 is a configurational view showing the whole body of a display apparatus that is an embodiment of the present invention.

The display apparatus 1 of the embodiment is equipped with a liquid crystal panel 10, in which thin film transistor (TFT) liquid crystal cells are formed in a matrix, a plurality of source drivers (X drivers) 20 to drive the source lines (signal lines) of the liquid crystal panel 10, a plurality of gate drivers (Y drivers) 30 to drive the gate lines (scanning lines) of the liquid crystal panel 10, a timing controller 40, which supplies various timing signals to the source drivers 20 and the gate drivers 30 and receives display data from the outside to supply the received display data to the source drivers 20, and a power supply circuit 50 to generate the operating voltages of respective circuits and the driving voltages of the liquid crystal cell 10.

The liquid crystal panel 10 includes the source lines and the gate lines according to the screen resolution thereof. For example, if the liquid crystal panel 10 has a screen resolution of 1440×900 pixels, then the liquid crystal panel 10 has 1440×3 source lines and 900 gate lines because the liquid crystal panel 10 has three cells of red (R), green (G), and blue (B) per pixel.

Each of the source drivers 20 drives a plurality of source lines (for example, 432 source lines) of the liquid crystal panel 10, and all of the source lines of the liquid crystal panel 10 can be driven by providing the plurality of source drivers 20 (for example, ten source drivers 20).

Each of the gate drivers 30 similarly drives a plurality of gate lines (for example, 300 gate lines) of the liquid crystal panel 10, and all of the gate lines of the liquid crystal panel 10 can be driven by providing the plurality of gate drivers 30 (for example, three gate drivers 30).

Then, the driving voltages for one horizontal line are output to all the source lines every horizontal period by the plurality of source drivers 20, and one gate line is sequentially driven every horizontal period by the plurality of gate drivers 30. The liquid crystal cells for one horizontal line on which the source lines and the gate line cross with each other are thereby sequentially driven, and a display operation is performed.

Figure 2:
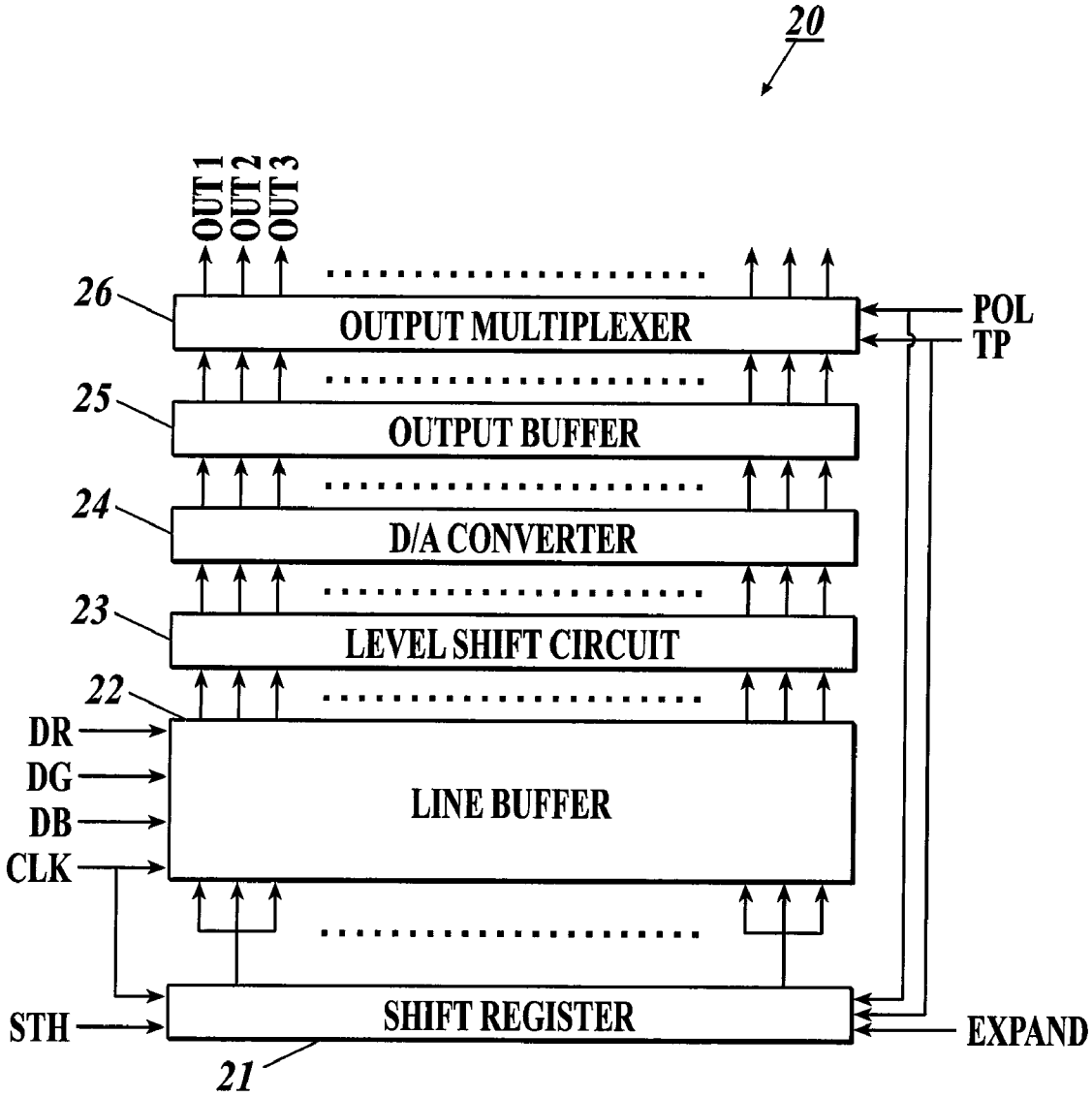
FIG. 2 is a block diagram showing the configuration of a source driver of FIG. 1.

FIG. 2 shows a block diagram of each of the source drivers 20. In the figure, DR, DG, and DB denote display data for one pixel (for three colors); CLK denotes a transfer clock of display data; STH denotes a horizontal start pulse indicating a start of one horizontal period; TP denotes a data load pulse indicating the drive timing of a source line; and POL denotes a polarity control signal for switching the positive and negative polarities of a driving voltage, the high level and the low level of which polarity control signal are adapted to be inverted every horizontal line and every frame. Moreover, EXPAND denotes an expansion control signal indicating the turning on and off of image expansion, and is supplied from, for example, the timing controller 40.

Each of the source drivers 20 is composed of a line buffer 22 including a plurality of latch circuits to latch display data for predetermined pixels on the same horizontal line, a shift register 21 to output latch signals indicating latch timing to the respective latch circuits of the line buffer 22, a level shift circuit 23 to raise the signal level (for example, 3.3 V) of the data system to the signal level (for example, 12-17 V) of the drive system, a D/A converter 24 to convert digital display data into analog drive signals, an output buffer 25 to receive the analog drive signals to output predetermined gradation voltages (of bipolar ones) according to the received analog drive signals, an output multiplexer 26 to alternately output any one polarity voltage of the bipolar gradation voltages output from the output buffer 25 in order to prevent burn-in of the liquid crystal cells, and the like.

The three pieces of display data (DR, DG, and DB) for three colors of one pixel and a data transfer clock CLK are simultaneously input into the line buffer 22, and these pieces of display data are adapted to be latched by the latch circuits (three latch circuits of red, green, and blue) for one pixel among the plurality of latch circuits. Such data latching is repeated for predetermined pixels (for example, for 144 pixels), and thereby the pieces of display data for predetermined pixels of the same horizontal line are adapted to be latched by the plurality of latch circuits.

The shift register 21 sequentially outputs the latch signals to control which latch circuit the display data is latched by among the plurality of latch circuits in the line buffer 22. Because the configuration of the above line buffer 22 is the one to which the three pieces of display data for three colors of one pixel are simultaneously input, one latch signal is output at an interval of the input timing of the display data of one pixel from the shift register 21, and the configuration is the one in which the latch signal is distributed to three latch circuits for one pixel. Furthermore, the line buffer 22 is configured in such a way that the output line for outputting the latch signal is normally shifted by one at an interval of the input timing of the display data of one pixel.

Figure 3:
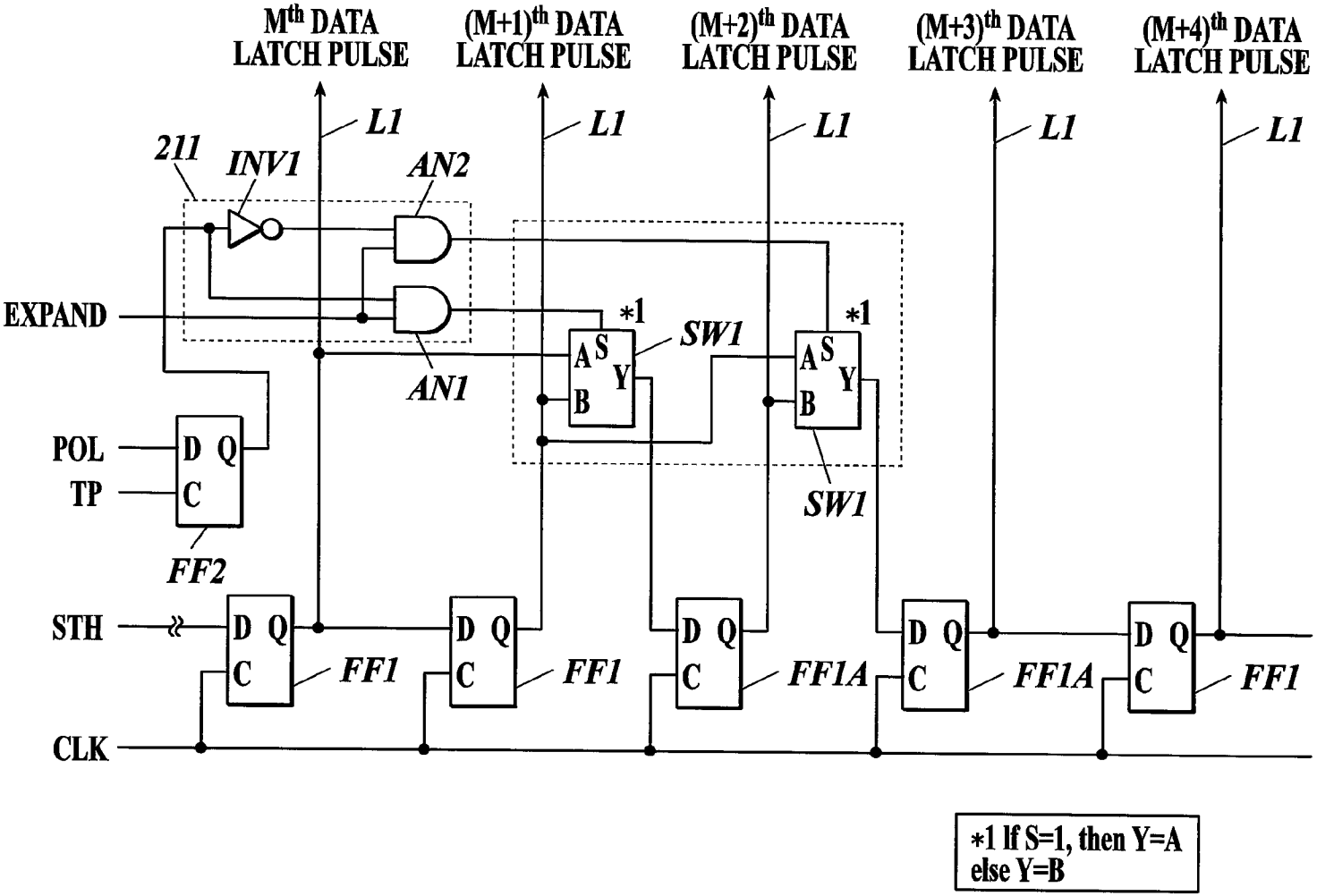
FIG. 3 is a circuit configuration diagram showing the configuration of a part of a shift register provided in the source driver.

FIG. 3 shows the circuit configuration diagram of a part of the shift register 21.

The shift register 21 includes a plurality of output lines L1 for outputting latch signals to the plurality of latch circuits of the line buffer 22, a plurality of flip-flops FF1 and FF1A provided respectively to the plurality of output lines L1 to be connected in a line and to constitute the shift register 21, change-over switches SW1 for switching the connections of the data input terminals D of specific flip-flops FF1A, logical block 211 performing the on-off control of the change-over switches SW1 and alternately switching a couple of successive two change-over switches SW1 in a staggered connection state, flip-flop FF2 latching a polarity control signal POL in order to alternately switch the two change-over switches SW1, and the like.

Incidentally, the output lines L1 and the flip-flops FF1 and FF1A are each provided for the number of the pixels dealt with by the line buffer 22 (for example, 144), and the change-over switches SW1 are provided as a couple of two of them provided every predetermined interval (for example, every three or four flip-flops FF1 or FF1A). Moreover, the signal lines from the logical block 211 are configured to be connected to each couple of change-over switches SW1 similarly.

The flip-flops FF1 and FF1A are, for example, D flip-flops. Each of the data input terminals D of the flip-flops FF1 that are not associated with any change-over switches SW1 is connected with the data output terminal Q of the preceding stage flip-flops FF1 (or FF1A), and the clock terminals C of the flip-flops FF1 are connected to receive the input of the same transfer clock CLK.

Each of the data input terminals D of the flip-flops FF1A that are associated with the change-over switches SW1 is connected to the data output terminal Q of the preceding stage flip-flop FF1 (or FF1A) or the data output terminal Q of the second preceding stage flip-flop FF1 through the change-over switches SW1. The clock terminals C of the flip-flops FF1A are connected to receive the same transfer clock CLK.

Each of the change-over switches SW1 switches the connection of the terminal Y thereof to the terminal A or B thereof on the basis of a signal of the control terminal S thereof. For example, each of the change-over switches SW1 is configured as follows. When the input of the control terminal S is the logic "1," the terminal Y is connected to the terminal A. When the input of the control terminal S is the logic "0," the terminal Y is connected to the terminal B.

The logical block 211 is composed of two AND circuits AN1 and AN2, each of which outputs a control signal to each of the control terminals S of the couple of change-over switches SW1, and an inverter INV1 connected to the input terminal of the AND circuit AN2. An expansion control signal EXPAND is adapted to be input into one input terminal of each of the AND circuits AN1 and AN2, and the polarity control signal POL latched by the flip-flop FF2 is adapted to be input to the other input terminal of each of the AND circuits AN1 and AN2. Moreover, the polarity control signal POL is adapted to be inverted and input only into the AND circuit AN2 on the one side through the inverter INV1.

The flip-flop FF2 is configured to use a data load pulse TP as a clock input, and to latch the polarity control signal POL every horizontal period to output the latched polarity control signal POL to the logical block 211.

By this configuration, when the expansion control signal EXPAND is the low level, the logical block 211 outputs a signal of the logic "0" to the two change-over switches SW1, and each of the data input terminals D of all the flip-flop FF1A is connected to the data output terminal Q of the preceding stage flip-flop FF1 or FF1A. A normal shift register is thus configured.

On the other hand, when the expansion control signal EXPAND is the high level, the signals of the logics "0" and "1" are output from the logical block 211 to the change-over switches SW1, and thereby the data input terminal D of one of the respective two flip-flops FF1A is connected to the data output terminal Q of the second preceding stage flip-flop FF1, and the data input terminal D of the other flip-flops FF1A is connected to the data output terminal Q of the preceding stage flip-flop FF1 or FF1A.

Consequently, the flip-flops FF1A that receive the data input from second preceding stage flip-flops in the shift register composed of the plurality of flip-flops FF1 and FF1A operate to output latch signals by the same transfer clock CLK as that of the outputs of the preceding stage flip-flops FF1 (or FF1A). Furthermore, the timing of the succeeding flip-flops FF1 is accelerated by one transfer clock CLK, and the succeeding flip-flops FF1 operate so that latch signals are sequentially output by the subsequent transfer clocks CLK.

Moreover, each of the flip-flops FF1A receiving the data input from the second preceding stage flip-flops among the couples of the flip-flops is adapted to be alternately switched every horizontal line and every frame by the polarity control signal POL input to the logical block 211.

Figure 4A:
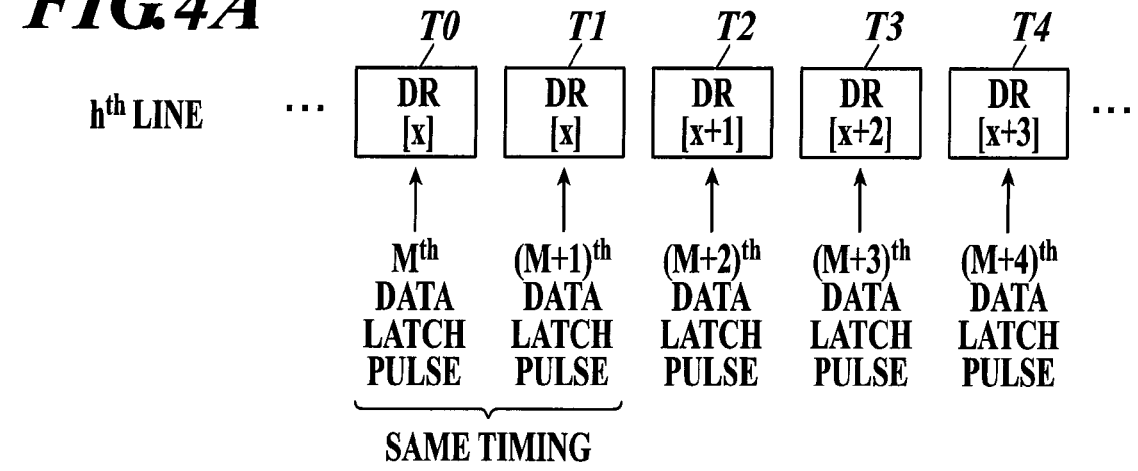
FIGS. 4A, 4B and 4C are explanatory diagrams showing a storage state of display data to be latched in a line buffer by the shift register of FIG. 3.
Figure 4B:
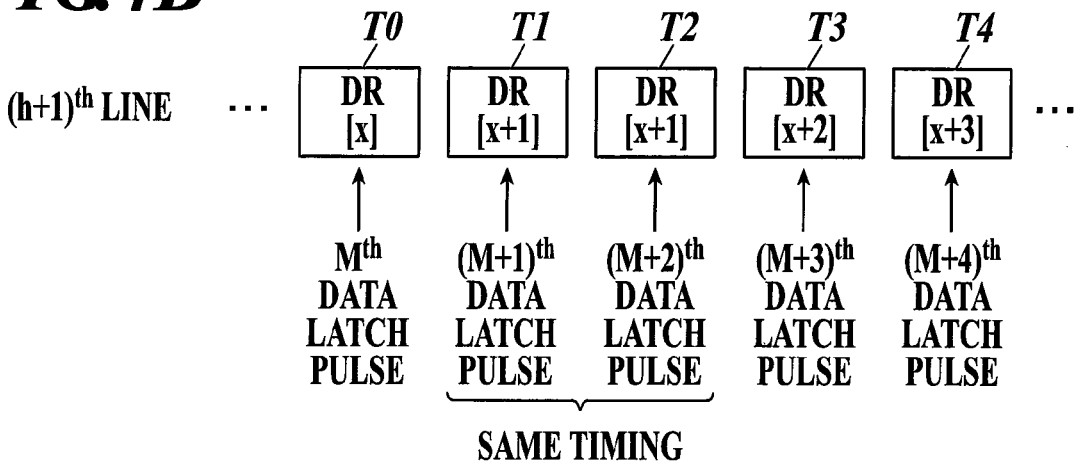
Figure 4C:
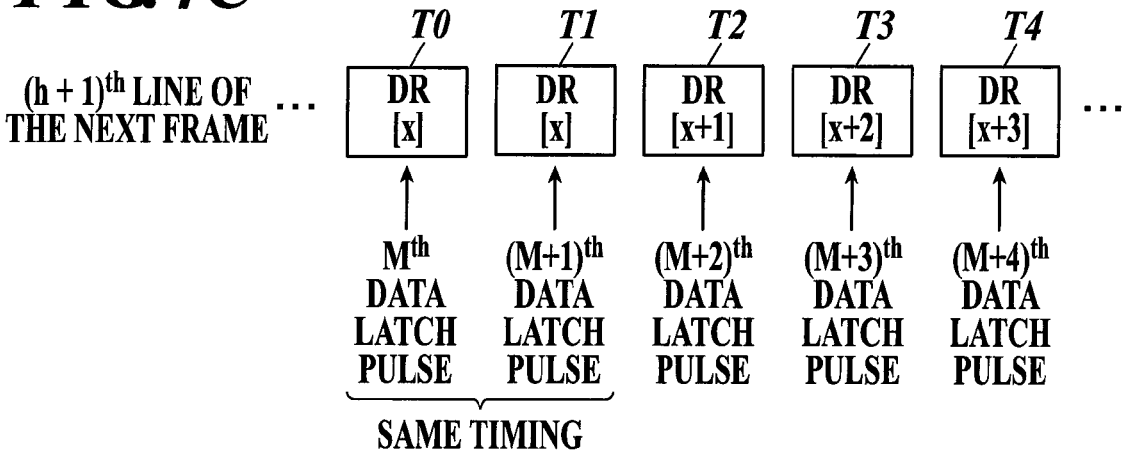

FIG. 4 shows the diagrams for illustrating the storage states of the display data latched by the line buffer 22 by the operation of the shift register 21. Incidentally, the three pieces of display data for three colors are simultaneously latched in three latch circuits by one latch signal in the line buffer 22, but FIG. 4 shows only the red display data DR for simplification.

As described above, when the expansion control signal EXPAND is the high level, latch signals are output from two output lines at the same timing. For example, if a control signal of the logic "1" is input into the change-over switch SW1 on the left side in FIG. 3 in the processing of the $h^{th}$ horizontal line, then the $M^{th}$ and the $(M+1)^{th}$ latch signals are output at the same timing by the same transfer clock CLK as shown in FIG. 4(*a*), and the $(M+2)^{th}$ and succeeding latch signals are sequentially output by the succeeding transfer clocks CLK.

Consequently, the red data DR[x] at the $x^{th}$ pixel in the X-coordinate is latched in both the $M^{th}$ and $(M+1)^{th}$ latch circuits T0 and T1. Moreover, the red data DR[x+1]–DR[x+3] following the $(x+1)^{th}$ pixel are adapted to be sequentially latched in the $(M+2)^{th}$ and succeeding latch circuits T2, T3, and T4.

Moreover, a control signal of the logic "1" is input into the change-over switch SW1 on the right side in FIG. 3 in the processing of the successive $(h+1)^{th}$ horizontal line, and then the $(M+1)^{th}$ and the $(M+2)^{th}$ latch signals are output at the same timing by the same transfer clock CLK as shown in FIG. 4(*b*). Then, the latch signals before and after the $(M+1)^{th}$ and the $(M+2)^{th}$ latch signals are sequentially output one by one every transfer clock CLK.

Consequently, the red data DR[x+1] at the $(x+1)^{th}$ pixel is latched in both the $(M+1)^{th}$ and $(M+2)^{th}$ latch circuits T1 and T2. Moreover, the red data continuing before and after the red data DR[x+1] are latched in the latch circuits T0, T3, and T4 before and after the latch circuits T1 and T2, respectively, one by one.

In this manner, the display data for one frame is processed while the couples of the latch circuits that latch the same display data are alternately switched between the couple of the latch circuits T0 and T1 and the couple of the latch circuits T1 and T2 every horizontal line. Moreover, after the processing of the display data for one frame, the display data for other frames is processed so that the couples of the latch circuits latching these pieces of the same display data are alternately switched, as shown in FIG. 4(*c*).

Then, by such operations, for example, the pieces of display data for four pixels are latched in the line buffer 22 in the state of being expanded to the pieces of display data for five pixels. The display data is transmitted to the level shift circuit 23, the D/A converter 24, the output buffer 25, and the output multiplexer 26 to drive the source lines of the liquid crystal panel 10. Thus the input display data is displayed onto the liquid crystal panel 10 in the state of being expanded in the horizontal direction.

Incidentally, the rate of the horizontal expansion of a display image increases by increasing the rate of the provided change-over switches SW1, and the rate of the horizontal expansion of the display image decreases by decreasing the rate of the provided change-over switches SW1. For example, a piece of display data including 1024 pixels in the horizontal direction can be expanded to fill the entire screen including 1440 pixels in the horizontal direction by providing a couple of the change-over switches SW1 to every three or four flip-flops FF1, and thereby the display output of the display data of 1024 pixels can be performed.

Moreover, the provision of the two change-over switches SW1 correspondingly to the successive two flip-flops FF1A and FF1A and the switching of the change-over switches SW1 every one horizontal line and one frame so that the connection state of the change-over switches SW1 may be staggered prevent the fixing of the positions where one pixel is expanded to two pixels and disperse the positions right and left every horizontal line and every frame. Consequently, images can be smoothly expanded for performing the display output.

Figure 5:
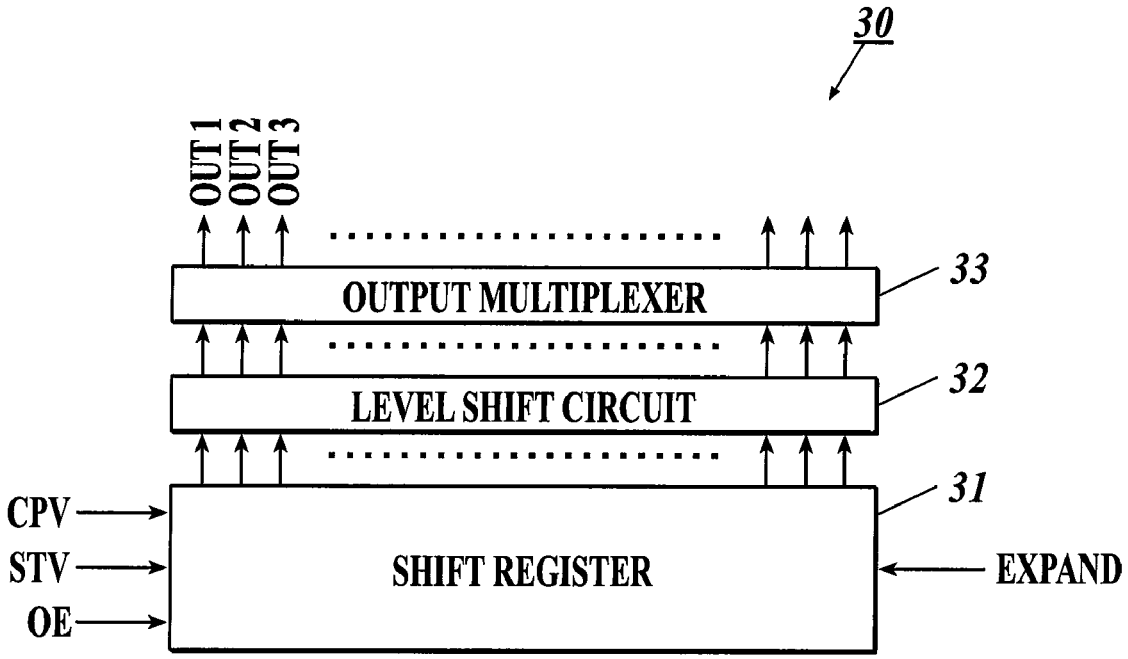
FIG. 5 is a block diagram showing the configuration of a gate driver of FIG. 1.

FIG. 5 shows a block diagram of each of the gate drivers 30. In the figure, CPV denotes a vertical shift clock for shifting the drive timing of gate lines one by one; STV denotes a vertical start pulse of a vertical period; and OE denotes an enable signal for allowing the drive of the gate lines.

Each of the gate drivers 30 is composed of a shift register 31 for sequentially outputting a timing signal (gate enable pulse) for driving any one of a plurality of gate lines; a level shift circuit 32 to raise a signal level from the level of the control system (for example, 3.3 V) of the gate driver 30 to the level of the drive system (for example, the low level of 6 V and the high level of 23 V) of the gate driver 30; an output multiplexer 33 to output driving voltages to the gate lines, and the like.

Figure 6:
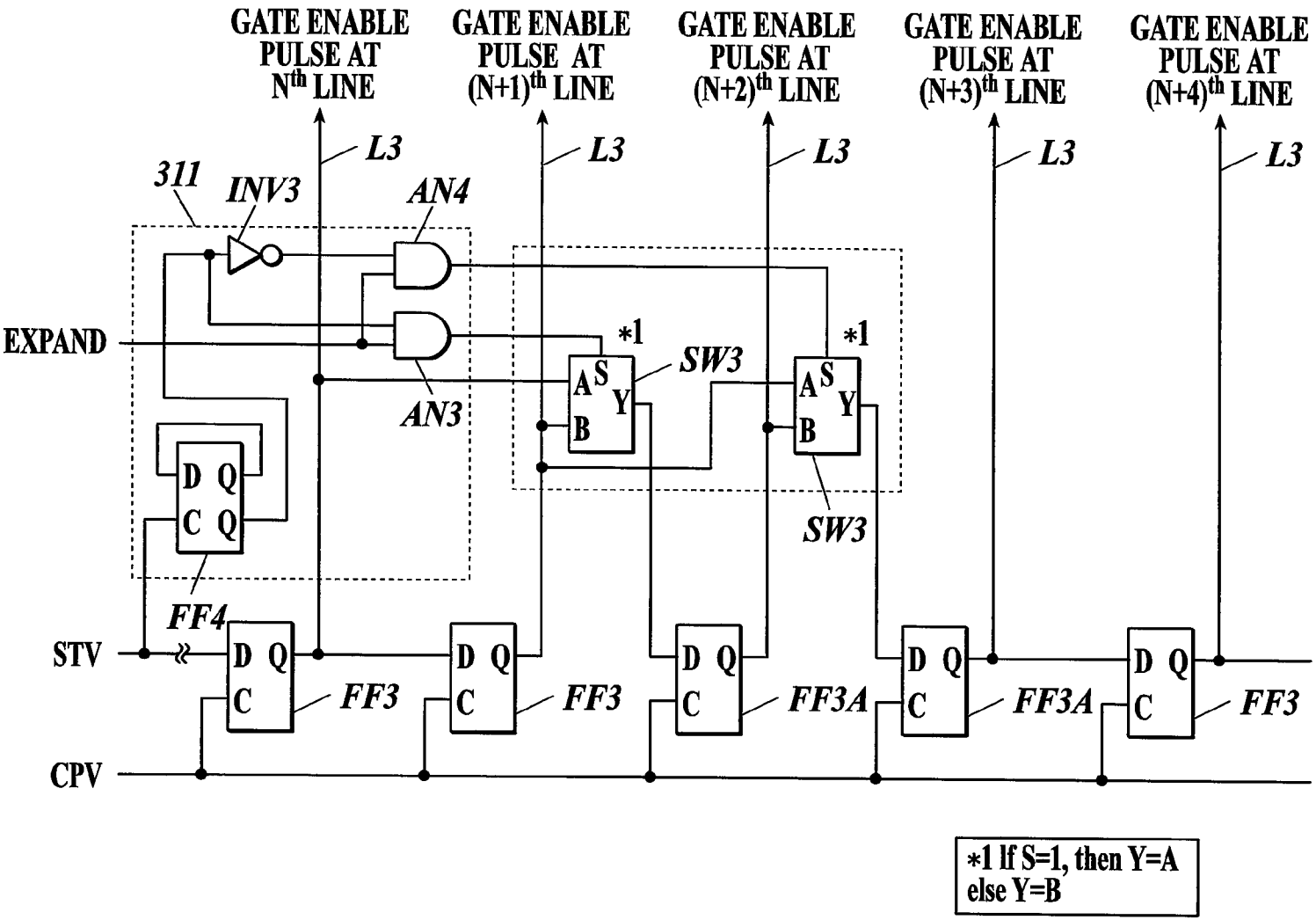
FIG. 6 is a circuit configuration diagram showing the configuration of a part of a shift register provided in the gate driver.

FIG. 6 shows the circuit configuration diagram of a part of the shift register 31.

The shift register 31 includes a plurality of output lines L3 each associated with each of a plurality of gate lines to be driven by the gate driver 30; a plurality of flip-flops FF3 and FF3A provided respectively to the plurality of output lines L3, and connected to each other in a line to constitute the shift register; change-over switches SW3 for switching the connections of the data input terminals D of the specific flip-flops FF3A; and logical block 311, each performing the on-off control of the change-over switches SW3 and the alternate switching of the two change-over switches SW3 in a staggered state.

Because the configurations of the flip-flops FF3 and FF3A and the change-over switches SW3 are the same as those of the flip-flops FF1 and FF1A and the change-over switches SW1 of FIG. 3, respectively, their descriptions are omitted.

The logical block 311 differs from the logical block 211 of FIG. 3 only in the configuration for alternately switching the two change-over switches SW3, and the other configurations of the logical block 311 are the same as those of the logical block 211. The logical block 311 is equipped with a flip-flop FF4, which inverts the output thereof every vertical period in order to alternately switch the two change-over switches SW3. The logical block 311 is adapted to input the output of the flip-flop FF4 into one AND circuit AN3 as it is, and to invert the output before inputting the output into the other AND circuit AN4.

Each of the flip-flops FF4 uses the vertical start pulse input at every frame as the clock input thereof, and is adapted to output a signal inverting every frame from the data output terminal Q thereof by connecting the data input terminal D thereof to the inverted data output terminal $\overline{Q}$.

By such a configuration, when the expansion control signal EXPAND is the low level, a normal shift register is configured by the flip-flops FF3 and FF3A, and the shift register 31 operates to output a timing signal from the plurality of the output lines L3 every input of the vertical shift clock CPV one by one in order.

On the other hand, when the expansion control signal EXPAND is the high level, the connection of any one of the specific flip-flops FF3A, for example, the flip-flop FF3A on the left side is switched, and timing signals are output from the Nth and the $(N+1)^{th}$ output lines L3 at the same timing. Timing signals are output from the output lines L3 after the $(N+1)^{th}$ output line L3 in order one by one every vertical shift clock CPV.

Alternatively, the connection of the input terminal of the flip-flop FF3A on the right side of the specific flip-flops FF3A is switched, and timing signals are output from the $(N+1)^{th}$ and the $(N+2)^{th}$ output lines L3 at the same timing. Timing signals are output from the output lines L3 before the $(N+1)^{th}$ output line L3 and after the (N+2) th output line L3 every vertical shift clock CPV in order one by one. Such switching is then performed every frame.

By the above configuration, for example, the timing signals for driving successive two gate lines are simultaneously output from the shift register 31, and the timing signals are transmitted to the level shift circuit 32 and the output multiplexer 33 to be led to simultaneously drive successive two gate lines of the liquid crystal panel 10. Consequently, the liquid crystal cells for the successive two horizontal lines in the liquid crystal panel 10 are led to be driven on the basis of the display data of one horizontal line, and the display data for one line is led to be output to be displayed in the state of being expanded to the display data for two lines. Moreover, if only the part shown in FIG. 6 is considered, the display data for four lines is lead to be output to be displayed in the state of being expanded to be the display data for five lines.

By such operation, the expansion rate of display image in the vertical direction is increased by increasing the rate of providing the above change-over switches SW3 in the shift register 31, and the expansion rate of the display image in the vertical direction is decreased by decreasing the rate of providing the change-over switches SW3. For example, it becomes possible to expand the display data including 768 pixels in vertical direction to the liquid crystal panel including 900 pixels in vertical direction to perform display output by providing a couple of change-over switches SW3 every three or four flip-flops FF3.

Moreover, the provision of the two change-over switches SW3 correspondingly to the successive two flip-flops FF3A and the switching of the change-over switches SW3 every one frame so that the connection state of the change-over switches SW3 may be staggered prevent the fixing of the positions where display data for one line is expanded to two lines and disperse the positions every frame. Consequently, images can be smoothly expanded for performing the display output.

As described above, according to the display apparatus 1 configured as above, low resolution display data can be expanded to be displayed on a high resolution liquid crystal panel by the expansion processing of the source drivers 20 and the gate drivers 30 without providing any dedicated resealing process circuits and any frame buffers. Moreover, because the display data transmitted from the outside to the timing controller 40 and the display data transmitted to the source drivers 20 remain in the state of low resolution display data even in that case, the display data can be dealt with at a slow transfer speed for a low resolution. Consequently, it is also possible to set the operation speed of the timing controller 40 to a speed for a low resolution to attain the reduction of power consumption.

Incidentally, the present invention is not limited to the embodiment described above, but various changes can be performed. For example, although the shift register 21 of FIG. 3 adopts the configuration of providing each of the couples of change-over switches SW1 correspondingly to each of the two successive flip-flops FF1A to alternately switch each of the couples of change-over switches SW1, the change-over switches SW1 may not be provided as couples but individually. Then, the logical block 211 realizing the alternate switching of the coupled change-over switches SW1 may be omitted, and the change-over switches SW1 may be configured so as to be individually controlled only by the expansion control signal EXPAND in this case. By this configuration, each of the positions at which one pixel is expanded to two pixels is fixed, but the circuit configuration can be simplified. Such a modification can be similarly applied to the shift resisters 31 of the gate drivers 30 of FIG. 6 too.

Moreover, although the shift register 21 of FIG. 3 sets the timing of alternately switching the coupled change-over switches SW1 to be every horizontal line and every frame on the basis of the polarity control signal POL, a dedicated timing signal may be generated, and the alternate switching may be performed at arbitrary timing, such as every frame and every several horizontal lines.

Moreover, a plurality of series of the change-over switches SW1, logical block 211, and the expansion control signal EXPAND may be parallelly provided, and the rate of providing the change-over switches SW1 to each series may be different from each other. Thereby, if the first series circuits are operated, then the display expansion of 3:4 is enabled. If the second series circuits are operated, then the display expansion of 1:2 is enabled. Thus, such a configuration of selecting expansion rates among a plurality of them may be adopted. Also the modification can be similarly applied to the shift register 31 of FIG. 6 of each of the gate drivers 30.

Figure 7:
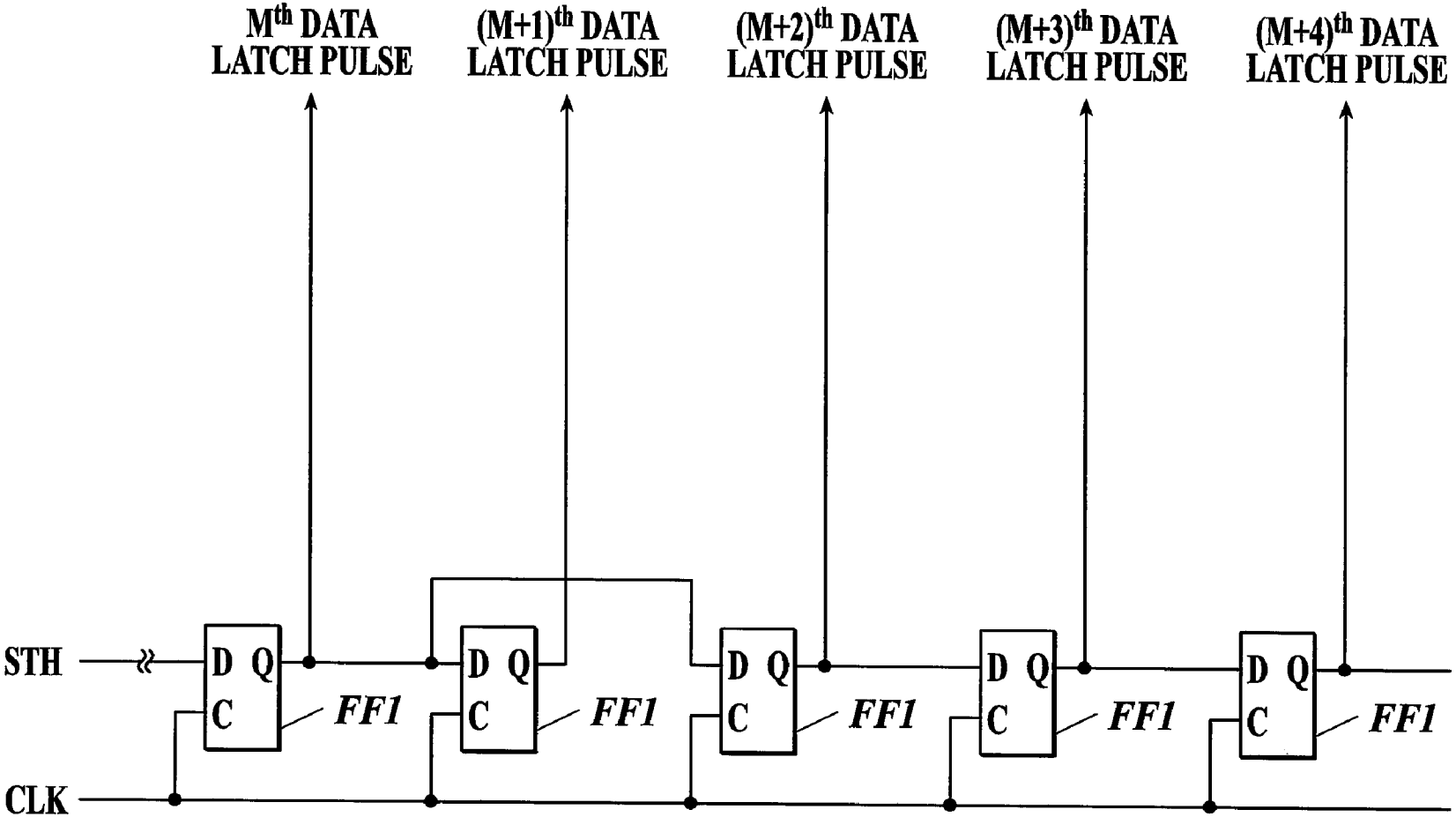
FIG. 7 is a circuit configuration diagram showing a modification of a source driver that can perform only an expansion operation in a fixed way.
Figure 8:
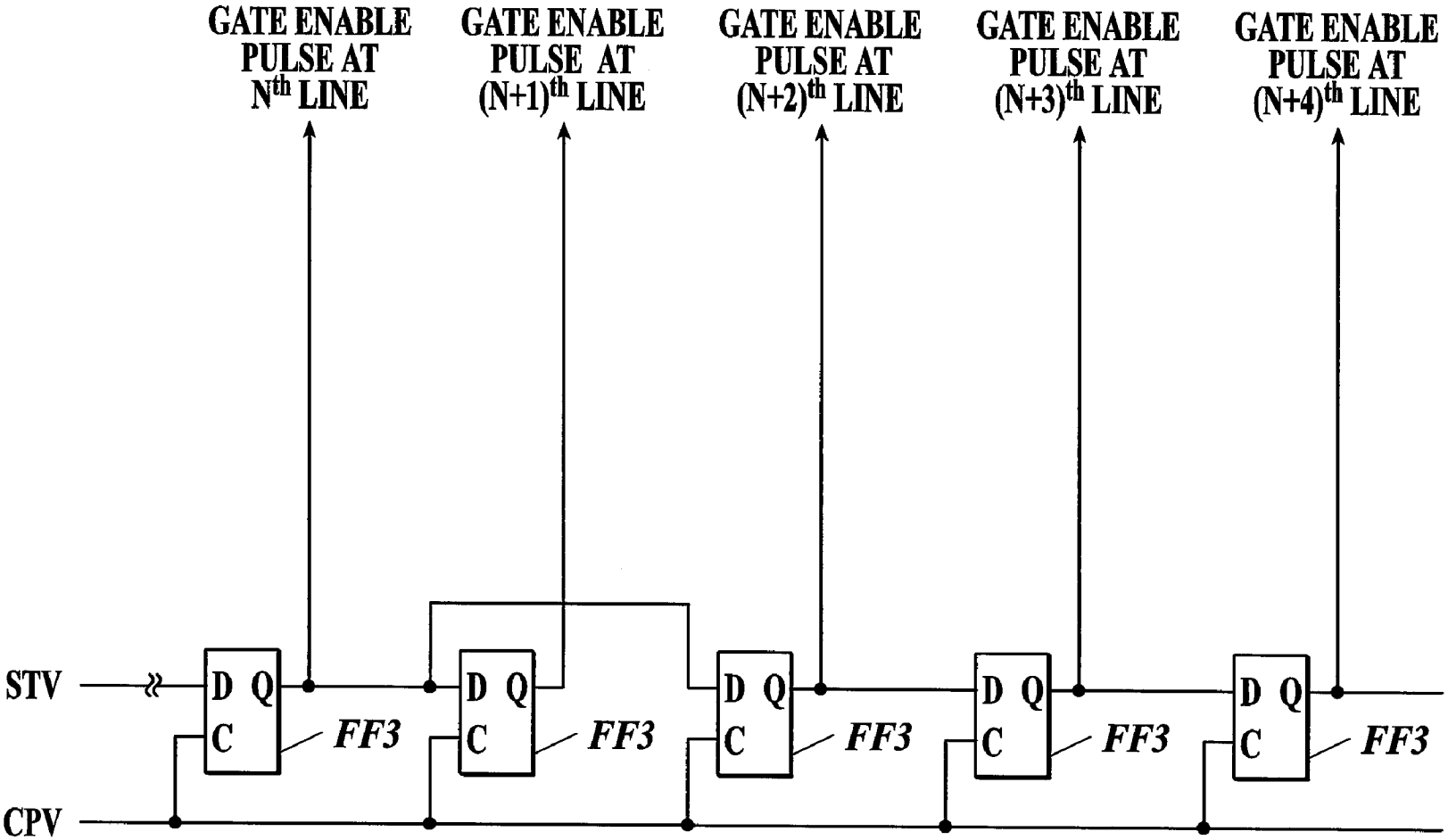
FIG. 8 is a circuit configuration diagram showing a modification of a gate driver that can perform only an expansion operation in a fixed way.

FIGS. 7 and 8 show the circuit configuration diagrams of the shift registers of a source driver and a gate driver, respectively, both capable of only fixed expansion operations.

Moreover, as shown in FIGS. 7 and 8, the shift registers having the wire connection structures in which the data input terminals D of the specific flip-flops FF1 and FF3 are previously connected with the data output terminals of the second preceding stage flip-flops FF1 and FF3, respectively, without providing any change-over switches SW1 and SW3, respectively, may be adopted. In this case, only the operation of expanding low resolution display data at a fixed rate to perform the expansion display of the low resolution data on a high resolution liquid crystal panel can be performed, and it becomes impossible to perform the display output of high resolution display data without expanding it. But, if this configuration is adopted by a display panel that always needs fixed expansion processing, then the circuit configuration thereof becomes the most simplified one.

Figure 9:
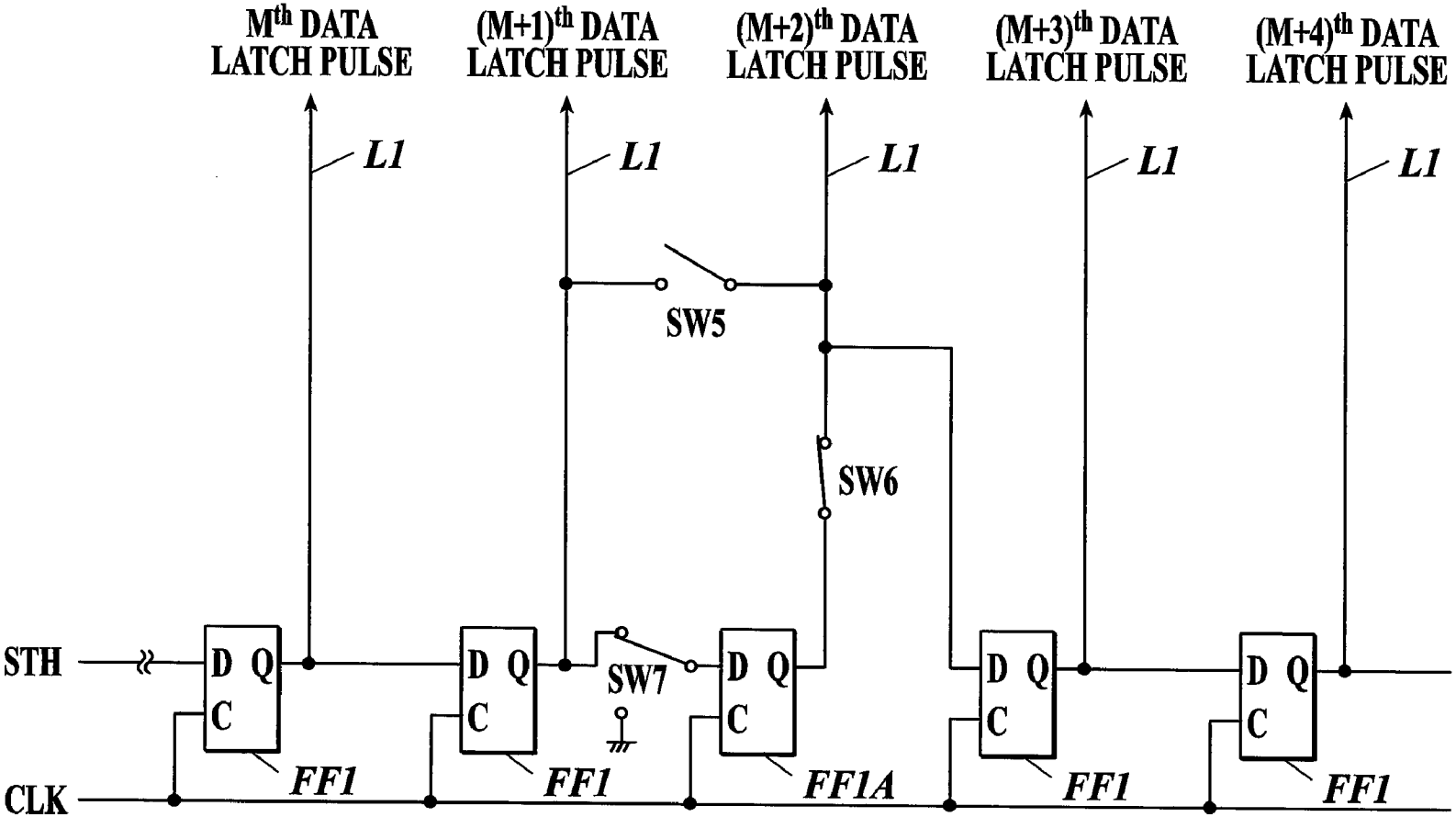
FIG. 9 is a configuration diagram for illustrating another wire connection structure of change-over switches in the shift register.

FIG. 9 shows the configuration diagram illustrating another wire connection structure of change-over switches in the shift registers.

Moreover, as shown in FIG. 9, the wire connection structures of the change-over switches are not limited to that shown in FIG. 3, but the other wire connection structures can obtain the same operation. For example, although the example of FIG. 3 adopts the wire connection structure to switch the data input terminals D of the predetermined flip-flops FF1A to the data output terminals Q of the second preceding stage flip-flops FF1 or the data output terminals Q of the preceding stage flip-flops FF1 by the change-over switches SW1, the same operation can be also obtained by switches SW5, SW6, and SW7 shown in FIG. 9.

Hereupon, the switches SW5 turn on and off the connections between the output lines L1 associated with the predetermined flip-flops FF1A and the data output terminals Q of the preceding stage flip-flops FF1; the switches SW6 turn on and off the connections between the output lines L1 associated with the predetermined flip-flops FF1A and the data output terminals Q of the flip-flops FF1A; and the switches SW7 switch the data input terminals D of the predetermined flip-flops FF1A between the data output terminal Q of the preceding stage flip-flops FF1 and the low level output.

Then, by switching the switches SW5 to be off, the switches SW6 to be on, and the switches SW7 to the sides of the data output terminals Q, the wiring structure becomes the connection of a normal shift register. By switching each of the switches SW5-SW7 to the reverse connections, it becomes possible to simultaneously output latch signals from the $(M+1)^{th}$ and the $(M+2)^{th}$ output lines L1, and to output a latch signal from the succeeding $(M+3)^{th}$ output line L1 by the successive transfer clock CLK.

In addition, although the TFT liquid crystal panel is exemplified as the display panel in the above-mentioned embodiment, the same advantages can be obtained to various display panels that similarly drive their scanning lines and their signal lines to perform display operations. Furthermore, the details shown in the embodiment can be suitably changed without departing from the spirit and the scope of the invention.

According to a first aspect of the preferred embodiment of the present invention, there is provided a display apparatus including: an X driver to drive a plurality of signal lines; and a Y driver to drive a plurality of scanning lines; wherein a display operation is performed by driving the scanning lines and the signal lines, wherein the X driver is provided with: a line buffer to receive sequential input of display data to latch the receive display data in a plurality of latch circuits; and a horizontal shift register to sequentially output latch signals to the plurality of latch circuits in accordance with an operation clock, wherein the horizontal shift register includes: a plurality of output lines through which the latch signals are output; and a plurality of flip-flops to output the latch signals to the plurality of output lines, the flip-flops being provided respectively to the plurality of output lines, wherein the horizontal shift register is configured to be able to output the latch signals from any of adjoining two output lines among the plurality of output lines by a same operation clock, and to be able to output a latch signal from a subsequent stage output line following to the two output lines by the next operation clock.

Specifically, it is preferred that the display apparatus further includes a change-over switch to switch a data input terminal of any one of the plurality of flip-flops to either one of a data output terminal of a preceding stage flip-flop and a data output terminal of a second preceding stage flip-flop, wherein the display apparatus can output the latch signals from the adjoining two output lines by the same operation clock and output the latch signal from the subsequent stage output line following to the two output lines by the next operation clock by the switching of the change-over switch.

By this means, the latch signals are simultaneously output from the adjoining two output lines of the shift register, and the timing for one output line is shortened. The latch signal is then output from the subsequent stage output line by the next operation clock. Hereby, in the line buffer, the same display data is led to be latched by the latch circuits for the successive two pixels, and the operation of expanding one pixel to two pixels is exerted. Consequently, by making such pixels be included in one horizontal line at a predetermined rate, the whole screen can be expanded by the predetermined rate in the horizontal direction.

Preferably, two of the change-over switches are provided correspondingly to any successive two flip-flops among the plurality of flip-flops, and the two change-over switches are configured to be alternately switched so as to be in a mutually reversed connection state.

By this configuration, the positions at each of which one pixel is expanded to two pixels can be dispersed right and left by alternate switching of two change-over switches. Generally, if one pixel is always expanded to two pixels at the same positions in one horizontal line, then the difference between the expanded positions and the not-expanded positions become conspicuous. But if the expanded positions are dispersed at suitably timing, then the screen can be entirely seen so that the images are averagely expanded.

Specifically, it is preferred that the two change-over switches are switched alternatively based on a polarity control signal to be generated for inverting polarities of driving voltages of the plurality of signal lines every frame and/or every horizontal line.

By this configuration, the expanded positions can be dispersed right and left at suitable timing without generating any special signals.

According to a second aspect of the preferred embodiment of the present invention, there is provided a display apparatus including: an X driver to drive a plurality of signal lines; and a Y driver to drive a plurality of scanning lines; wherein a display operation is performed by driving the scanning lines and the signal lines, wherein the Y driver is provided with a vertical shift register to output timing signals to sequentially drive the plurality of scanning lines, wherein the vertical shift register includes: a plurality of output lines to output the timing signals to the plurality of scanning lines; and a plurality of flip-flops to output each of the timing signals to the plurality of output lines, the flip-flops being provided respectively to the plurality of output lines, wherein the vertical shift register is configured to be able to output the timing signals from any of adjoining two output lines among the plurality of output lines by a same operation clock, and to be able to output a timing signal from a subsequent stage output line following to the two output lines by a next operation clock.

By this configuration, the operation of expanding one pixel to two pixels can be similarly exerted also into the vertical direction. By making such positions be included in a vertical line at a predetermined rate, the whole screen can be expanded into the vertical direction.

Moreover, by adding the same configuration as that of the X driver also to the Y driver, the same operation can be obtained.

As described above, according to the present invention, the processing of expanding an image is performed in the X driver and the Y driver to drive the signal lines and the scanning lines, respectively. Consequently, it is unnecessary to provide any dedicated signal processing circuits and any buffer memories for performing a resealing process, and the advantage of attaining the reduction of costs can be obtained.

Moreover, because expansion processing is performed by the X driver and the Y driver, even if a low resolution image is expanded to be displayed on a high resolution display panel, the display data to be transferred may be remained to be low resolution display data as it is, and also the transfer speed can be lowered by just that much. Consequently, also the power consumption of the transmitting and receiving circuit of the display data can be reduced.

The entire disclosure of Japanese Patent Application No. 2007-034511 filed on Feb. 15, 2007 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A display apparatus comprising:

a liquid crystal panel;

a source driver which is coupled to source lines of the liquid crystal panel to drive the source lines;

a gate driver which is coupled to gate lines of the liquid crystal panel to drive the gate lines; and a timing controller which is coupled to the source driver and the gate driver to output a predetermined timing signal and predetermined display data to the source driver and the gate driver, wherein the source driver includes:

a line buffer which includes a plurality of latch circuits and receives sequential input of the display data to latch the input display data into the latch circuits; and a horizontal shift register which is coupled to the line buffer to sequentially output a latch signal to the latch circuits, wherein the horizontal shift register includes:

a plurality of output lines from which the latch signal is output;

a plurality of flip-flops which are coupled to respective output lines to output the latch signal to the output lines and a plurality of change-over switches, each of which is coupled to any two of the flip-flops to connect a data input terminal of a subsequent stage flip-flop among the two flip-flops to either one of a data output terminal or a data input terminal of a preceding stage flip-flop, wherein a plurality of couples of the change-over switches are provided among the plurality of the flip-flops of the horizontal shift register at a predetermined interval from each other, wherein the gate driver includes a vertical shift register to output a timing signal for sequentially driving the gate lines, wherein the vertical shift register include:

a plurality of output lines to output the timing signal;

a plurality of flip-flops which are coupled to respective output lines to output the timing signal to the output lines; and a plurality of change-over switches, each of which is coupled to any two of the flip-flops to connect a data input terminal of a subsequent stage flip-flop among the two flip-flops to either one of a data output terminal or a data input terminal of a preceding stage flip-flop, wherein a plurality of couples of the change-over switches are provided among the plurality of the flip-flops of the vertical shift register at a predetermined interval from each other.

2. A display apparatus comprising:

an X driver which is coupled to a plurality of signal lines to drive the signal lines; and a Y driver which is coupled to a plurality of scanning lines to drive the scanning lines; wherein a display operation is performed by driving the scanning lines and the signal lines, wherein the X driver includes:

a line buffer which includes a plurality of latch circuits to receive sequential input of display data to latch the receive display data in the latch circuits; and a horizontal shift register which is coupled to the line buffer to sequentially output latch signals to the latch circuits in accordance with an operation clock, wherein the horizontal shift register includes:

a plurality of output lines through which the latch signals are output;

a plurality of flip-flops which are coupled to respective output lines to output the latch signals to the output lines; and at least one change-over switch coupled to any two of the flip-flops to switch a data input terminal of a subsequent stage flip-flop among the two flip-flops to either one of a data output terminal of a preceding stage flip-flop or a data output terminal of a second preceding stage flip-flop, wherein the horizontal shift register is configured to be able to output the latch signals from any of two adjoining output lines among the output lines by a same operation clock, and to be able to output a latch signal from a subsequent stage output line following the two output lines by the next operation clock by switching the at least one change-over switch.

3. The display apparatus according to claim 2, wherein two change-over switches are provided correspondingly to any respective two of the flip-flops among the plurality of flip-flops, and the two change-over switches are configured to be alternately switched so as to be in a mutually reversed connection state.

4. The display apparatus according to claim 3, wherein the two change-over switches are switched alternatively based on a polarity control signal to be generated for inverting polarities of driving voltages of the signal lines every frame and/or every horizontal line.

5. The display apparatus according to claim 2, wherein couples of change-over switches are provided at a predetermined interval among the plurality of flip-flops.

6. The display apparatus according to claim 2, wherein the X driver is a source driver to drive the source lines of a TFT liquid crystal panel, and the Y driver is a gate driver to drive the gate lines of the TFT liquid crystal panel.

7. A display apparatus comprising:

an X driver which is coupled to plurality of signal lines to drive the signal lines; and a Y driver which is coupled to a plurality of scanning lines to drive the scanning lines; wherein a display operation is performed by driving the scanning lines and the signal lines, wherein the Y driver includes a vertical shift register to output timing signals to sequentially drive the scanning lines, wherein the vertical shift register includes:

a plurality of output lines to output the timing signals to the scanning lines;

a plurality of flip-flops which are coupled to respective output lines to output each of the timing signals to the output lines; and at least one change-over switch coupled to any two of the flip-flops to switch a data input terminal of a subsequent stage flip-flop among the two flip-flops to either one of a data output terminal of a preceding stage flip-flop or a data output terminal of a second preceding stage flip-flop, wherein the vertical shift register is configured to be able to output the timing signals from any of two adjoining output lines among the output lines by a same operation clock, and to be able to output a timing signal from a subsequent stage output line following the two output lines by a next operation clock by switching the at least one change-over switch.

8. The display apparatus according to claim 7, wherein two change-over switches are provided correspondingly to any respective two of the flip-flops among the plurality of flip-flops, and the two change-over switches are configured to be alternately switched so as to be in a mutually reversed connection state.

9. The display apparatus according to claim 8, wherein the two change-over switches are switched alternately based on a signal to be output every frame.

10. A display drive circuit which is coupled to a plurality of signal lines of a display panel, or a plurality of scanning lines of the display panel, to drive the signal lines or the scanning lines comprising:

a shift register to generate latch timing to latch display data corresponding to the signal lines, or drive timing of the scanning lines, wherein the shift register includes:

a plurality of output lines to output timing signals;

a plurality of flip-flops which are coupled to respective output lines to output each of the timing signals to the output lines; and at least one change-over switch coupled to any two of the flip-flops to connect a data input terminal of a subsequent stage flip-flop among the two flip-flops to either one of a data output terminal or a data input terminal of a preceding stage flip-flop.

* * * * *